United States Patent [19]

Elhaus et al.

[11] 4,307,597

[45] Dec. 29, 1981

[54] PULLER FOR EXTRUSION PROFILES

[75] Inventors: Friedrich W. Elhaus, Jägerhofstr. 117a, D-5600 Wuppertal 1, Fed. Rep. of Germany; Eckhard Mäkel, Velbert, Fed. Rep. of Germany

[73] Assignee: Friedrich Wilhelm Elhaus, Wuppertal, Fed. Rep. of Germany; by said Eckhard Mäkel, a part interest

[21] Appl. No.: 91,124

[22] Filed: Nov. 5, 1979

[30] Foreign Application Priority Data

Aug. 16, 1979 [DE] Fed. Rep. of Germany ..... 2933262

[51] Int. Cl.[3] ..... B21B 35/02

[52] U.S. Cl. ..... 72/257; 72/422

[58] Field of Search ..... 72/254, 255, 257, 290, 72/291, 422; 226/158, 161, 162, 167; 271/268; 414/14, 20, 753; 24/134 L, 248 R; 269/231, 235, 236

[56] References Cited

U.S. PATENT DOCUMENTS

| | | | |
|---|---|---|---|
| 3,230,753 | 1/1966 | Walker | 72/257 |
| 3,537,286 | 11/1970 | Spielvogel et al. | 72/257 |
| 3,587,280 | 6/1971 | Engelhardt et al. | 72/257 |
| 3,881,339 | 5/1975 | Mannell | 72/257 |

FOREIGN PATENT DOCUMENTS

| | | | |
|---|---|---|---|
| 726000 | 10/1942 | Fed. Rep. of Germany | 269/231 |
| 1299589 | 7/1969 | Fed. Rep. of Germany | 72/257 |
| 1298964 | 6/1962 | France | 72/422 |

*Primary Examiner*—Lowell A. Larson

*Attorney, Agent, or Firm*—Laubscher, Philpitt & Laubscher

[57] ABSTRACT

A puller for extrusion profiles at an extruder is disclosed including a carriage which is movable on rails along a runout conveyor for the extrusion profiles and at which a puller head with a fixed and a movable clamping jaw is arranged for pivotal movement about a vertical axis so that the puller head may be swung laterally out of the runout conveyor. The two clamping jaws extend approximately across the width of the runout conveyor, and the movable clamping jaw comprises a plurality of clamping segments which are supported at the puller head for free swinging movement about a horizontal axis and adapted to be pivoted in opening sense by a drive means. The clamping segments are provided with clamping curves of such curvature that, at all pivot positions of the clamping segments, the points of contact between the extrusion profile to be clamped and the clamping curve always lie at least approximately on a clamping straight line intersecting the horizontal pivot axis at an inclination of a desired clamping angle with respect to a line perpendicular to the runout conveyor.

11 Claims, 6 Drawing Figures

PULLER FOR EXTRUSION PROFILES

BRIEF DESCRIPTION OF THE PRIOR ART

This invention relates to a puller for extrusion profiles at an extruder, comprising a carriage movable on rails along a runout conveyor for the extrusion profiles and including a puller head at which there are provided one fixed clamping jaw and one movable clamping jaw having a plurality of clamping segments and being supported for free swinging movement about a horizontal axis and adapted to be pivoted about said axis by a drive means in opening sense so as to release at least one extrusion profile which is clamped between the movable and fixed clamping jaws. A puller of this kind is particularly adapted for pulling out extruded aluminium profiles. In a known puller of this kind (as shown, for example, by German Off. No. 14 52 374) the clamping curves of the clamping segments are circular segments. The clamping straight lines, which are the connecting lines between the points of contact of the clamping segments with the extrusion profile to be clamped and the horizontal pivot axis, extend at different angles of inclination with respect to a perpendicular line on the runout plane, depending on the height of the extrusion profiles to be clamped, as measured from the runout conveyor. However, optimum clamping conditions are obtained only in a very limited range of clamping angles, i.e. in an extremely narrow range of angles of inclination of the clamping straight line. Therefore, if the extrusion profiles to be clamped differ very much in thickness, the known arrangement requires adjustment of the horizontal pivot axis to another position so that the angle of inclination of the clamping straight line can be kept within the very limited range of clamping angles mentioned. This necessitates not only an expensive structure but also cumbersome adjustment if other profile thicknesses are to be handled.

SUMMARY OF THE INVENTION

It is the object of the present invention to design a puller of the kind mentioned initially such that reliable and operationally safe clamping and release of the extrusion profiles are permitted by simple means with all extrusion profile thicknesses which the range of swinging of the clamping segments can cover.

To meet this object it is provided, in accordance with the invention, that each clamping segment is provided with a clamping curve of such curvature that, at all pivot positions of the clamping segment, the points of contact between the extrusion profile to be clamped and the clamping curve are always located at least approximately on a clamping straight line intersecting the horizontal pivot axis at an inclination of a desired clamping angle ($\alpha$) with respect to a line perpendicular to the plane of the runout conveyor.

For exact fulfillment of the condition that the clamping straight line interconnecting the points of contact mentioned and the horizontal pivot axis should be the same for all pivot positions, the clamping curve of each clamping segment must fulfill the equation $$r=r_1 \cdot e^{\phi \operatorname{tg} \alpha}$$

in which $\alpha$ = the clamping angle between a perpendicular line on the runout conveyor and the clamping straight line, $r_1$ = the spacing between the point of contact of the fixed and movable clamping jaws, i.e. at "zero position" without a clamped extrusion profile, and the horizontal pivot axis, $\frac{1}{8}$ = the angle by which the clamping segment is swung when clamping an extrusion profile, $r$ = the spacing between the point of contact of the clamping jaw and extrusion profile and the horizontal pivot axis at angle $\phi$.

It is possible to clamp all extrusion profile thicknesses which can be grasped by the clamping segments at the same clamping angles because of the fact that at least approximately the same clamping straight line is obtained for all pivot positions. The clamping angle can be so selected that it corresponds at least approximately to the desired optimum clamping angle. This is a clamping angle in the order between 30° and 40°, preferably 35° with respect to a line perpendicular to the plane of the runout conveyor.

In the known puller the clamping segments are pivoted so as to be opened by means of links subjected to the action of a spring. The force in opening sense varies in accordance with the deflection of the spring. This deflection, in turn, changes together with the different position of adjustment of the clamping segments mentioned above and with the age of the spring. If the spring becomes too weak or breaks, positive release of the extrusion profiles is no longer guaranteed. To avoid that, a puller of the kind mentioned initially with which the drive means acts by force lock in per se known manner so as to open the clamping segments, comprises a drive means which is embodied by a pressure fluid cylinder. When lifting the clamping segments for opening movement this pressure fluid cylinder always provides the same amount of force at any pivot position and, moreover, it guides the clamping segments during their downward movement into clamping position and keeps them from falling on the runout conveyor or the extrusion profiles to be clamped. In this context, advantageously, the piston rod of the pressure fluid cylinder may be designed as a rack and act on a pinion arranged on the horizontal pivot axis. The pinion is firmly connected with a link positioned parallel to the horizontal pivot axis, and the link cooperates in force lock with recesses at the back of the clamping segments.

An essential contribution to operational safety is provided in accordance with a further embodiment of the invention in that the puller head carrying the clamping segments is disposed at a cantilever arm and is pivotable together with the same about an axis at the carriage, which axis extends vertical to the plane of the runout conveyor, out of the operating position into a return position located laterally of the runout conveyor. When the carriage and puller head are moved back, the puller head is completely swung out of the range of the runout conveyor so that an operator working in the range of the runout conveyor is not endangered by the puller head which normally returns at high speed. Conveniently, the cantilever arm is likewise movable in pivoting sense by means of a pressure fluid cylinder which is preferably remotely controlled.

It is advantageous to have the puller head or the cantilever arm adjustable in height. This makes it possible to adjust the height of the fixed lower clamping jaw so as to adapt it to the position of the extrusion profiles, as higher profiles are positioned deeper than flat profiles.

Another feature of the invention increasing the operational safety resides in the fact that the center of gravity of the puller head lies approximately in the plane of a chain driving the carriage and/or of a buffer stopping undesired colliding movement, when the cantilever arm is located in the return position. This embodiment of the invention prevents the generation of a moment of inertia of the cantilever arm with the puller head and the clamping segments if the carriage is not stopped soon enough when returning at high speed and thus impacts on the buffer. It is another factor contributing to safety that the cantilever arm can be held in its respective pivot position exclusively by the pressure fluid cylinder producing this pivot position and dampening any undesired swinging of the cantilever arm with the puller head, thereby protecting the puller head and the clamping segments against any effects of mechanical stresses, such as impacts and the like, in particular when the pressure fluid cylinder is not operated.

The design in accordance with the invention of the puller head to be pivotable about a vertical axis permits particularly convenient and simple measuring of the pulling force which acts on the puller. This may be used for control of the speed of the puller. To this end a force sensor is provided at the puller head. In operation this force sensor is pressed against a fixed abutment at the carriage under the action of the pulling force, thereby detecting the pulling force which is available at the puller head and applying the same as the actual value to a control means for control of the speed of the carriage. This permits clamping of the extrusion profiles while a constant pulling force is being exerted. The control may also be derived from the ram speed of the extruder measured as the actual value. In this case the control means controls the speed of the carriage at a pulling force with upper and lower limits.

The puller in accordance with the invention is particularly well suited for combination with a severing means or cutter. In an especially simple manner not only the carriage but also a slide of this severing means is adapted to be moved and stopped, and control switches for stopping the carriage of the puller are provided at the slide. The puller head preferably is so designed that it can be moved into the area of the severing means above the front ends or beginnings of the extrusion profiles so that these front ends can be lifted unobstructedly into the clamping gap of the clamping jaws. In this manner synchronism may be achieved between the movements of extrusion profiles and the puller from the very beginning of the extrusion process.

Of course, all functions of operation and movement of the apparatus can be controlled automatically and in respect of each other so that substantially automatic operation is possible practically without any interference by an operator who merely continues to have monitoring functions.

BRIEF DESCRIPTION OF THE DRAWING

The invention will be described further by way of example, with reference to the accompanying drawings, in which.

DETAILED DESCRIPTION

Figures 1, 2:
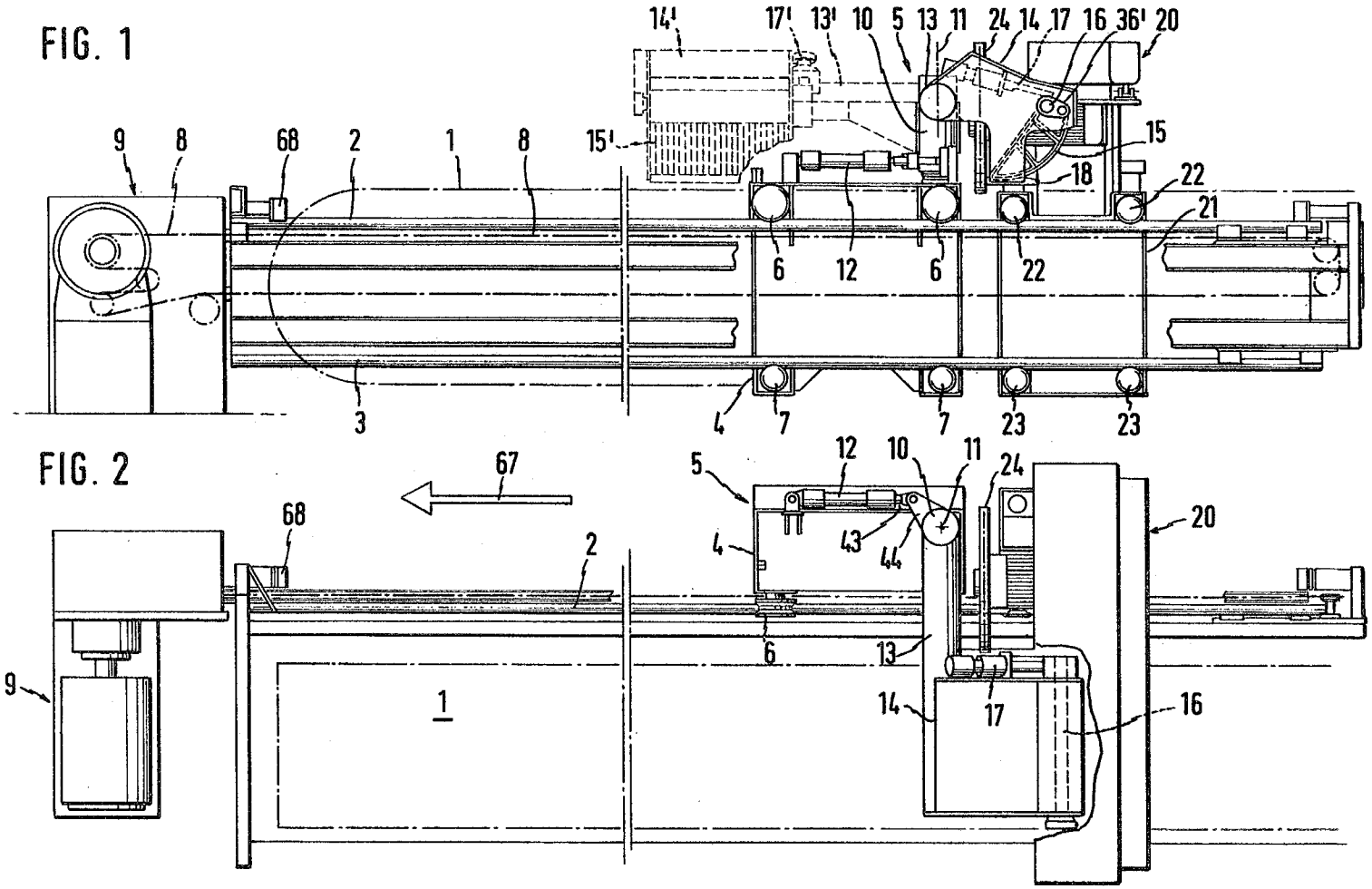
FIGS. 1 and 2 are a side and top view, respectively, of a puller arranged along a runout conveyor in a position ready to receive one or more extrusion profiles adjacent a severing means.

FIGS. 1 and 2 show the puller and its arrangement along a runout conveyor, the upper runout plane of which is designated by reference numeral 1 in FIGS. 1 and 2.

Parallel rails 2 and 3 are arranged approximately vertically above each other along this runout conveyor. The carriage 4 of the puller designated in general by reference numeral 5 runs on these rails by way of two upper rollers 6 and two lower rollers 7.

The carriage 4 is driven by an endless chain 8 which is movable in both directions by a drive means 9.

The carriage 4 of the puller 5 carries a vertical column 10 which is pivotable about a vertical pivot axis 11 by means of a pressure fluid cylinder 12 between two limit positions shown in FIGS. 1 and 2, one limit position being shown in continuous lines in FIGS. 1 and 2 and the other one being shown in discontinuous lines in FIG. 1. In the operating position, shown in continuous lines, a cantilever arm 13 which is rigidly connected with column 10 extends transversely of the runout conveyor. In the rest or return position shown in discontinuous lines in FIG. 1, on the other hand, this arm designated 13' extends parallel to the runout conveyor 1.

The cantilever arm 13 carries a puller head 14, designated 14' in the rest position according to FIG. 1. The puller head carries a plurality of clamping segments 15, 15' (return position in discontinuous lines) over almost the entire width of the runout conveyor. The clamping segments are mounted on the puller head 14 for pivoting movement about a horizontal axis 16 and are pivotable by means of a pressure fluid cylinder 17 with respect to a fixed clamping jaw 18 which is rigidly connected with the puller head 14, as will be described in greater detail below with reference to FIGS. 3 to 6.

The puller 5 is shown in FIGS. 1 and 2 in ready position to receive extrusion profiles. The carriage 4 is in its right terminal position on rails 2, 3 next to a severing means designated in general by reference numeral 20. This severing means is likewise movable on the rails 2, 3 by means of a slide 21 with rollers 22, 23, the range of movement extending between the right terminal position of the carriage 4 and the right end of the rail adjacent the die opening (not shown) of an extruder for aluminium or its alloys.

The puller 5 will be described in greater detail below with reference to FIGS. 3 to 6 in which the same reference numerals are used as in FIGS. 1 and 2.

Figure 3:
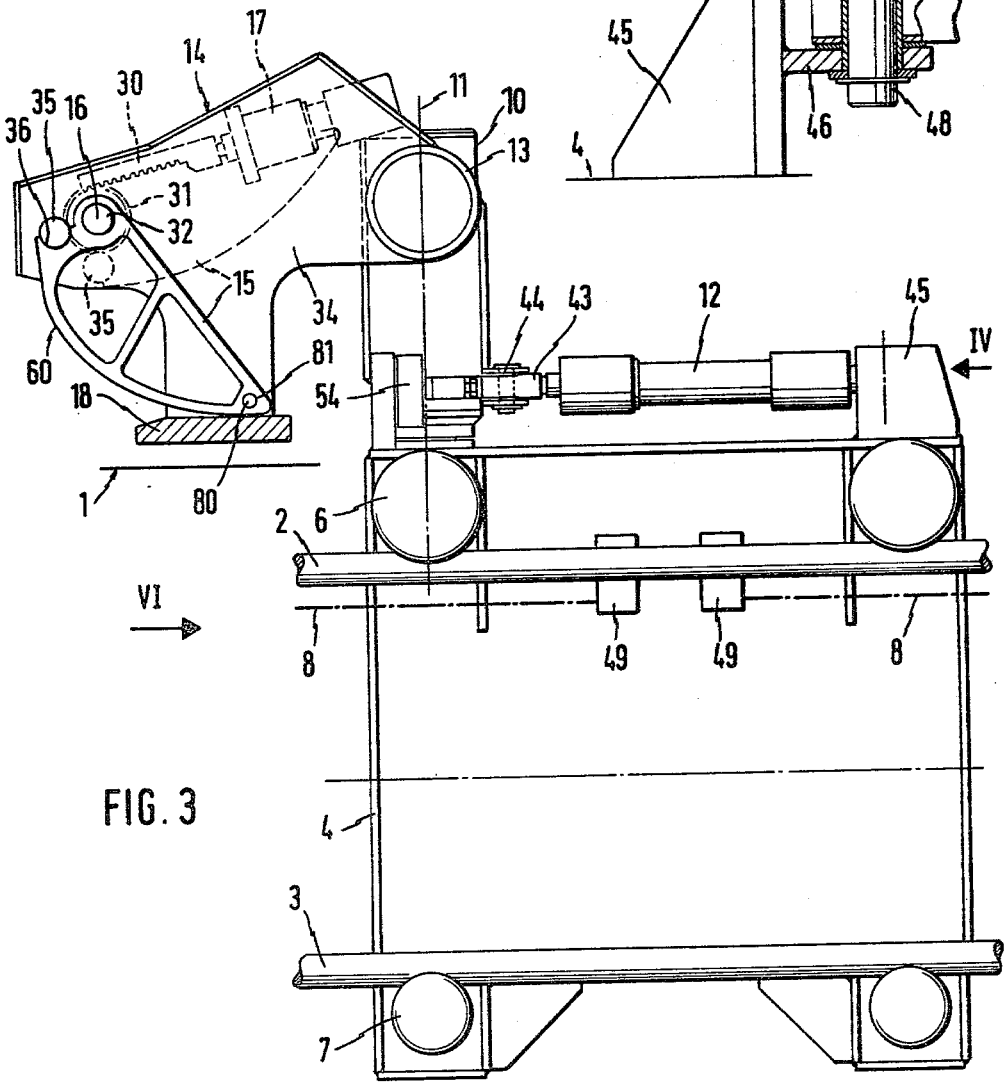
FIG. 3 is a partially cut view of the puller shown in FIG. 1, on an enlarged scale.

FIG. 3 is a more distinct presentation of the swinging drive of the clamping segments by means of the pressure fluid cylinder 17. The piston rod of this pressure fluid cylinder 17 is extended in the form of a rack 30 acting on a pinion 31 which is fixed for rotation on a shaft 32 coaxial with the horizontal pivot axis 16. Shaft 32 extends across all clamping segments and, as shown in FIG. 6, is supported in a side wall 34 of the puller head 14.

A link 35 extends parallel to shaft 32 and is rigidly connected with said shaft 32 by means of a fishplate 36' (FIG. 1). Thus the link 35 as well as shaft 32 passes above all clamping segments 15 and, in the condition shown in FIGS. 1 and 3, is in force lock engagement with semicircular recesses 36 at the back of the clamping segments 15. Upon actuation of the pressure fluid cylinder 17, rack 30 is extended to the left, as seen in FIG. 3, thereby effecting counter-clockwise rotation of the pinion 31 and thus also of the link 35. The link 35 takes along the clamping segments in a sense of rotation in counterclockwise direction at which the clamping segments move away from the fixed clamping jaw 18 of the puller head 14.

Figure 4:
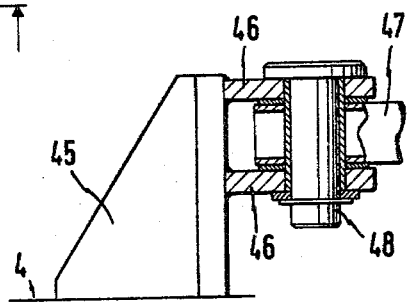
FIG. 4 is a view in the direction of arrow IV in FIG. 3, showing a detail of the puller according to FIG. 3.
Figure 6:
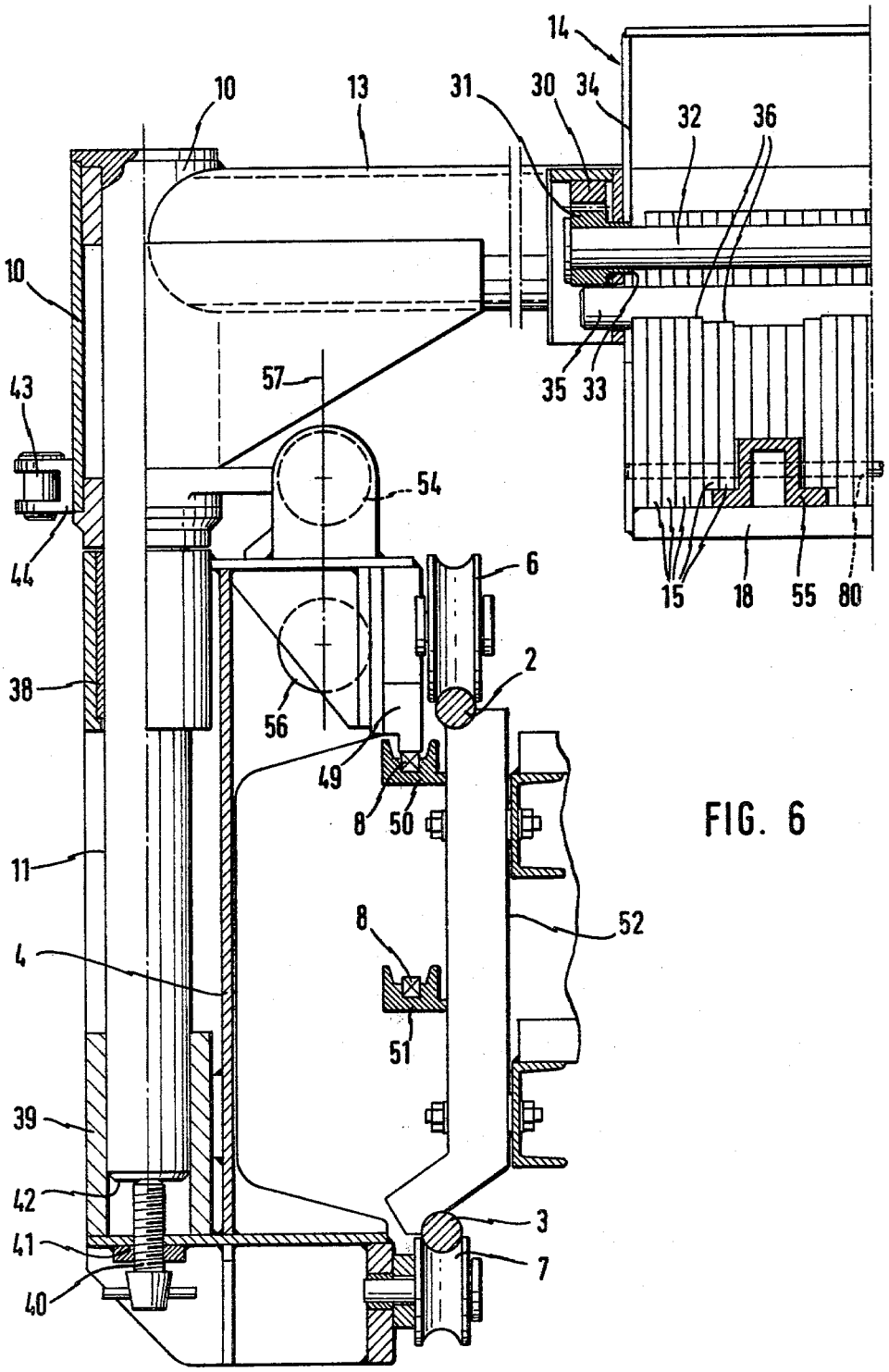
FIG. 6 is a view of the puller, partially cut and broken away, in the direction of arrow VI in FIG. 3.

In FIGS. 3 and 6 also column 10 carrying the cantilever arm 13 with the puller head 14 is shown more clearly. Column 10 is supported in bearing sleeves 38, 39 on pivot axis 11 for pivoting movement. Pivot axis 11 and together with it column 10 are adjustable in height by means of a setscrew 40 (FIG. 6) screwed into a stationary adjustment nut 41 in coaxial alignment with the axis 11 and engaging at the lower end face 42 of the axis 11. By means of its piston rod 43 the pressure fluid cylinder 12 pivoting column 10 is hingedly connected at a forked lug 44 fixed at the column. The hinged connection of the other end of the pressure fluid cylinder at the carriage 4 is best shown in FIG. 4 which illustrates an upright frame member 45 on carriage 4 and two connecting elements 46 between which a hinge connecting piece 47 of the pressure fluid cylinder 12 is inserted and held by a vertical bearing bolt 48 about which the hinged end and thus the pressure fluid cylinder may pivot in a horizontal plane. The structure at the hinge connection end according to FIG. 4 and/or at the hinge connection end according to FIG. 6 of the piston rod at the column 10 may be so designed that the height can be balanced if the vertical axis 11 is adjusted. An an alternative, the piston rod 43 may be embodied by a rack engaging a toothed segment which is fixed to the column 10. This permits automatic balancing of the height.

FIGS. 3 and 6 show blocks 49 fixed on the carriage 4 for securing both ends of the endless chain 8 at the carriage 4. Further shown in FIG. 6 are guide pieces 50 and 51 for the upper and lower runs, respectively, of the chain 8. These guide pieces are provided at a stationary carrying structure 52 which holds the rails 2, 3 (FIG. 6). Further to be seen in FIGS. 3 and 6 is a force sensor 54 which permits measuring of the force acting between the carriage 4 and the column 10, i.e. the effective pulling force which is transferable from the clamping segments 15 to an extrusion profile 55 (FIG. 6). This pulling force serves as the actual value for control of the drive means 9 such that the pulling force is kept at a predetermined, constant rated value.

Finally, FIG. 6 shows a buffer 56 disposed in the same vertical plane as the center of gravity of the puller head 14 with the cantilever arm 13 in the return position shown in discontinuous lines in FIG. 1. The vertical plane mentioned is shown as a vertical line in FIG. 6 and marked by reference numeral 57. By virtue of this arrangement of the buffer 56 at the right end of the path of movement of the puller 5, as seen in FIGS. 1 and 2, (not shown in these figures) it is guaranteed that no harmful moment is generated in case of a collision caused by the fact that the puller 5 has not been decelerated sufficiently or stopped in time during its return movement. However, if the arm 13 should yet be caused to swing back out of the return position shown in FIG. 1, such movement is dampened by the pressure fluid cylinder 12.

The structure of the clamping curve 60 of each clamping segment 15 will now be explained in greater detail with reference to FIG. 5.

The clamping segment 15 is shown in three different pivot positions. The position shown in a continuous line corresponds to that shown in FIGS. 1 and 3 at which the clamping segment rests on the fixed clamping jaw 18. The point of contact between the clamping curve 60 and the clamping jaw 18 is designated 61. In the pivot position shown in discontinuous lines, the clamping curve 60 rests on an extrusion profile 62 of a thickness $h_1$, the point of contact between this extrusion profile 62 and the clamping segment being designated 63. In the pivot position shown in dash-dot line, the clamping segment clamps an extrusion profile 64 of greater thickness $h_2$, the point of contact between the clamping curve 60 and the surface of the extrusion profile 64 being designated 65. The clamping curve 60 is of such design that the respective connection between the points of contact 61, 63, 65 lies on a common straight line 66 intersecting the horizontal axis. This straight line 66 is the so-called clamping straight line forming a clamping angle $\alpha$ together with a line perpendicular to the plane of the runout conveyor which extends parallel to the surface of the fixed clamping jaw 18. Conveniently, this clamping angle is selected to be in the order of 35°. This is the optimum clamping angle at which the clamping segments which are suspended for free swinging movement about the axis 16 exert almost the same clamping action on extrusion profiles of different thickness in any pivot position.

In order for the points of contact 61, 63, 65 to lie exactly on the common straight line 66, the clamping curve must fulfill the equation $$r = r_1 \cdot e^{\phi \, tg\alpha}$$

in which $\alpha$ = the clamping angle mentioned $r_1$ = the spacing between the point of contact 61 and the axis 16, $\phi$ = the angle by which the respective clamping segment 15 is swung to clamp an extrusion profile ($\phi = 0$ in the continuous line position)

$r$ = the spacing between the respective point of contact, e.g. 63 or 65 and the axis 16.

Figure 5:
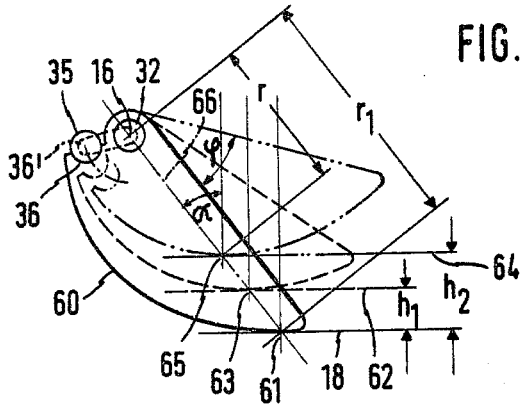
FIG. 5 is a view similar to FIG. 3, showing the clamping segments in different clamping positions.

FIG. 5 also shows that, in operating position, the clamping segments clamping extrusion profiles no longer abut against the link 35 by their recesses 36. It is only upon actuation of the cylinder 17 that the link 35 is moved into force lock engagement with the recesses 36 whereupon it swings all clamping segments into the return position shown in discontinuous lines in FIG. 3.

The course of operation of the puller according to the invention is as follows:

The puller 5 is moved into the position ready for operation, as shown in FIGS. 1 and 2, in which it is prepared to receive extrusion profiles issuing from the die opening. The extrusion profile or profiles are advanced from the right, as seen in FIGS. 1 and 2 and are raised by means of a lifting device (not shown) so that their ends are lifted from the plane of the runout conveyor 1 to the level of the surface of the fixed clamping jaw 18 and introduced into the puller head 14 between the fixed clamping jaw 18 and the clamping segments 15 which are raised automatically in correspondence with the possibly different thicknesses of the extrusion profile (cf. extrusion profile 55 in FIG. 6), carrying out corresponding pivoting movements about the axis 16. In this manner the extrusion profile or profiles are clamped. The puller 5 then is moved at controlled speed and controlled pulling force in the direction of pulling 67 (FIG. 2) along the runout conveyor. The speed is controlled so as to be adapted to the exit speed at which the extrusion profiles leave the die opening. The pulling force is controlled to have a constant value, the actual value being measured by means of the force sensor 54.

When the end of the pulling distance at the far left in FIGS. 1 and 2 is repeated, carriage 4 touches an abutment 68 which actuates limit switches for switching off the drive means 9 and switching on the pressure fluid cylinder 17. The latter pivots the clamping segments 15 into the release position shown in discontinuous lines in FIG. 3. Furthermore, the pressure fluid cylinder 12 is actuated so as to pivot the cantilever arm 13 together with the puller head 14 into the return position shown in discontinuous lines in FIG. 1. As seen in FIG. 2, the cantilever arm 13 is positioned parallel to and above the rail 2. In this return position the puller 5 is moved back at high speed at which the carriage 4 adopts the position shown in FIGS. 1 and 2. In this position the cantilever arm 13 is moved back from the position 13' shown in discontinuous lines in FIG. 1 into the ready position shown in continuous lines in FIGS. 1 and 2, at which position the puller head comes to lie below the severing means where it is ready to take up a new extrusion profile.

Likewise conceivable is a kind of operation at which all clamping segments 15 are coupled together positively for common movement. For this purpose a coupling rod designated 80 in FIGS. 3 and 6 may be provided to be extended through aligned bores 81 in the clamping segments. This coupling rod 80 may serve to connect all clamping segments 15 to form a continuous upper clamping jaw. In this manner lateral drifting forces are avoided which might strain the clamping segments 15. FIG. 6, however, shows the individual clamping described above with individual movability of the segments, where no coupling rod 80 is inserted. For clamping of the extrusion profile 55 by means of coupled clamping segments, all the segments shown in FIG. 6 would have to be illustrated with their lower edge at the same highest level of the extrusion profile.

What we claim is:

1. In a pulling apparatus for displacing extrusion profiles (62) produced by an extruder, including a carriage (4) displaceable on rails (2, 3) mounted adjacent an endless runout conveyor (1), puller head means (5) including a fixed clamping jaw (18), a movable clamping jaw having a plurality of clamping segments (14') supported for free swinging movement about a horizontal pivot shaft (32), and drive means (17, 30, 31) for pivoting said clamping segments toward opening positions relative to said fixed clamping jaw, thereby to release an extrusion profile that is clamped between the movable and fixed jaws; the improvement wherein (a) each clamping segment includes adjacent the fixed jaw a clamping curve surface (60) the configuration of which fulfills the equation $$r = r_1 \cdot e^{\phi tg\alpha}$$

wherein $\alpha$ = the clamping angle between a line perpendicular to the runout conveyor and the clamping straight line (66) between the moveable segment pivot axis and the point of contact (61) between the movable and fixed jaws in the absence of an extrusion profile;

$r_1$ = the distance between the pivot axis (16) of the movable segments and the point of contact (61) of the movable and fixed jaws in the absence of an extrusion profile;

$\phi$ = the angle through which the movable clamping segments are swung when clamping an extrusion profile; and $r$ = the distance between the movable segment pivot axis (16) and the point of engagement (65) between the movable clamping jaw segments and the extrusion profile;

thereby to cause, at all pivot positions of each clamping segment, the points of contact (61, 63, 65) between the clamping curve surface and the extrusion profile to be always located at least approximately on a clamping straight line (66) intersecting the horizontal pivot axis at a clamping angle ($\alpha$) of from 30° to 40° with respect to a line perpendicular to the plane of the runout conveyor.

2. Apparatus as defined in claim 1, wherein the drive means acts via links on the clamping segments in opening sense, characterized in that the drive means is embodied by a pressure fluid cylinder (17).

3. Apparatus as defined in claim 2, wherein said pressure fluid cylinder includes a piston rod, and further including rack and pinion means (30, 31) driven by said rod, said pinion (31) being disposed on the horizontal pivot axis (16), in that the pinion (31) is firmly connected with a link (35) disposed parallel to the horizontal pivot axis (16), and in that the link (35) cooperates in force lock with recesses (36) at the back of the clamping segments (15).

4. A puller as claimed in claim 1, characterized in that the puller head (14) carrying the clamping segments (15) is disposed on a cantilever arm (13) and is pivotable together with the same about an axis (11) at the carriage (4), which axis is perpendicular to the plane of the runout conveyor (1), out of the operating position into a return position (14') located laterally of the runout conveyor (1).

5. A puller as claimed in claim 4, characterized in that the cantilever arm (13) is movable in pivoting sense by means of a second pressure fluid cylinder (12).

6. A puller as defined in claim 2, characterized in that the puller head (14) is adjustable in height.

7. A puller as claimed in claim 2, characterized in that, with the cantilever arm (13) swung into return position, the center of gravity of the puller head (14) with the cantilever arm (13) lies approximately in the plane of a chain driving the carriage (4) and/or a buffer (56) which stops undesired colliding movement.

8. A puller as defined in claim 1, characterized in that a force sensor (54) is provided at the puller head and, in operation, is pressed against a fixed abutment (54') at the carriage under action of the pulling force, thereby detecting the pulling force which is available at the puller head (14) and feeding the same as actual value to a control means for control of the speed of the carriage.

9. A puller as claimed in claim 1, characterized in that the ram speed of the extruder is measured and fed as actual value to the control means which controls the speed of the carriage (4) at a pulling force with upper and lower limits.

10. A puller as defined in claim 1, and further including severing means (20) having a slide (21) adapted to be moved and stopped on the rails (2, 3) in an area thereof between the extruder and a desired end position of the carriage (4), and in that control switches are provided at the slide (21) for stopping the carriage (4) of the puller.

11. A puller as claimed in claim 10, characterized in that the puller head (14) is movable into the range of the severing means (20) above the front ends of the extrusion profiles such that these front ends can be lifted unobstructedly into the clamping gap of the clamping jaws (14, 18).

* * * * *